US008230755B2

(12) United States Patent
Ishikawa et al.

(10) Patent No.: US 8,230,755 B2
(45) Date of Patent: Jul. 31, 2012

(54) MULTI-DIRECTIONAL INPUT APPARATUS

(75) Inventors: Shinji Ishikawa, Miyagi-ken (JP); Kuniharu Kutsuna, Aichi-ken (JP); Yasuhiko Yamazaki, Aichi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 340 days.

(21) Appl. No.: 12/424,256

(22) Filed: Apr. 15, 2009

(65) Prior Publication Data

US 2009/0255353 A1 Oct. 15, 2009

(30) Foreign Application Priority Data

Apr. 15, 2008 (JP) ..... 2008-105879

(51) Int. Cl.
*G05G 9/047* (2006.01)
*G05G 1/00* (2008.01)

(52) U.S. Cl. ..... 74/471 XY; 74/470

(58) Field of Classification Search ..... 74/471 XY, 74/469, 470, 480 R, 473.33
See application file for complete search history.

(56) References Cited

U.S. PATENT DOCUMENTS

| | | | | | |
|---|---|---|---|---|---|
| 3,554,459 | A * | 1/1971 | Matsui | 242/239 |
| 3,638,952 | A * | 2/1972 | Ban | 360/73.06 |
| 3,757,597 | A * | 9/1973 | Vogel et al. | 74/471 XY |
| 3,870,986 | A * | 3/1975 | Oka et al. | 338/128 |
| 4,248,102 | A * | 2/1981 | Shimazu et al. | 74/10.33 |
| 4,587,510 | A * | 5/1986 | Kim | 338/128 |
| 4,607,159 | A * | 8/1986 | Goodson et al. | 250/221 |
| 4,736,647 | A * | 4/1988 | Shimoie et al. | 74/471 XY |
| 4,857,881 | A * | 8/1989 | Hayes | 338/128 |
| 6,259,433 | B1 * | 7/2001 | Meyers | 345/161 |
| 6,462,731 | B1 * | 10/2002 | Stoffers et al. | 345/161 |
| 6,622,379 | B1 * | 9/2003 | Kano | 29/740 |
| 6,655,229 | B2 * | 12/2003 | Yamamoto et al. | 74/471 XY |
| 7,176,892 | B2 * | 2/2007 | Kobayashi | 345/161 |
| 2005/0066751 | A1 * | 3/2005 | Harris | 73/864.45 |

FOREIGN PATENT DOCUMENTS

| | | |
|---|---|---|
| JP | 06-012137 | 1/1994 |
| JP | 2005-332156 | 12/2005 |

* cited by examiner

*Primary Examiner* — Justin Krause
*Assistant Examiner* — Gregory Prather
(74) *Attorney, Agent, or Firm* — Brinks Hofer Gilson & Lione

(57) ABSTRACT

A multi-directional input apparatus includes a swinging member (first drive lever) having a through hole and an operating lever including a drive shaft which is inserted through the long hole. When the operating lever is tilted in a direction that crosses an axial direction of the swinging member, the swinging member is rotated by the drive shaft. A leaf spring is attached to the swinging member, and the drive shaft of the leaf spring is elastically biased against a side surface of an inner wall of the long hole. The leaf spring includes a bent portion which extends substantially parallel to the axial direction of the swinging member and which is in elastic contact with the drive shaft. A hole at which the long hole is completely exposed is formed in the leaf spring.

4 Claims, 5 Drawing Sheets

MULTI-DIRECTIONAL INPUT APPARATUS

CLAIM OF PRIORITY

This application claims benefit of the Japanese Patent Application No. 2008-105879 filed on Apr. 15, 2008, which is hereby incorporated by reference.

BACKGROUND OF THE INVENTION

1. Field of the Invention

The present invention relates to a multi-directional input apparatus which includes an operating member provided with a drive shaft and which outputs an electric signal in accordance with a tilting direction and a tilting angle of the drive shaft when the operating member is tilted. More particularly, the present invention relates to a multi-directional input apparatus including a swinging member which has a long hole through which the drive shaft is inserted and which is rotated when the drive shaft is tilted.

2. Description of the Related Art

In this type of multi-directional input apparatus, when the operating member supported such that the operating member is tiltable in multiple directions is tilted, an electric signal can be obtained which differs in accordance with the tilting direction and the tilting angle of the operating member. Therefore, the multi-directional input apparatus is suitable for use as, for example, an input apparatus in which functions of multiple control devices, such as an air conditioner, an audio device, and a navigation device, that are mounted on a vehicle are adjusted using a single operating member.

Japanese Unexamined Patent Application Publication No. 6-12137 discloses an example of such a multi-directional input apparatus. This multi-directional input apparatus includes a swinging member that is rotatably supported on a base and an operating member provided with a drive shaft that is inserted through a long hole formed in the swinging member. When the operating member is tilted in a direction that crosses an axial direction of the swinging member, the swinging member is rotated by the drive shaft and an electric signal corresponding to the rotation angle of the swinging member is output from a detector, such as a variable resistor. As in the structure of the related art disclosed in Japanese Unexamined Patent Application Publication No. 6-12137, a pair of swinging members having the above-described structure may be arranged such that the axial directions thereof extend perpendicular to each other, and the drive shaft of the operating member may be inserted through long holes formed in the swinging members. In such a case, the tilting direction and the tilting angle of the operating member tilted in an arbitrary direction can be detected from output values obtained by a pair of detectors which correspond to the swinging members. In the structure of the related art, rolling elements, such as bearings, are attached to the drive shaft of the operating member so that the rolling elements roll along the inner walls of the long holes in the swinging members when the operating member is tilted. The rolling elements are provided to prevent rattling when the operating member is repeatedly tilted and contact surfaces between the drive shaft of the operating member and the inner walls of the long holes are worn.

Japanese Unexamined Patent Application Publication No. 2005-332156 discloses another example of a multi-directional input apparatus. This multi-directional input apparatus includes a swinging member and a swinging holder which is supported such that the swinging holder is rotatable along a plane perpendicular to an axial direction of the swinging member. A drive shaft of an operating member is rotatably supported by the swinging holder, and the axial direction of the drive shaft is substantially parallel to the axial direction of the swinging member. Also in this structure, the tilting direction and the tilting angle of the operating member tilted in an arbitrary direction can be detected from output values obtained by a pair of detectors which correspond to the swinging member and the swinging holder.

In the structure of the related art disclosed in Japanese Unexamined Patent Application Publication No. 6-12137, the rolling elements, such as bearings, are attached to the drive shaft of the operating member to prevent wear. Therefore, even when the operating member is repeatedly tilted, a possibility that rattling will occur between the drive shaft of the operating member and the inner walls of the long holes in the swinging members is low. However, slight clearances must be provided between the rolling elements and the inner walls of the long holes so that the rolling elements attached to the drive shaft can be placed in the long holes. Therefore, in the case where, for example, the multi-directional input apparatus is mounted on a vehicle, there is a risk that the rolling elements will come into contact with the inner walls of the long holes due to vibration generated when the vehicle is driven. In such a case, abnormal sound called rattling noise will be generated. In addition, the structure of the related art in which the rolling elements, such as bearings, are attached to the drive shaft of the operating member is complex. Therefore, a high component cost and an assembly cost are incurred. As a result, the cost of the multi-directional input apparatus will be increased.

In the structure of the related art disclosed in Japanese Unexamined Patent Application Publication No. 2005-332156, the cost is not increased since no rolling element, such as bearing, is additionally provided. However, a clearance must be provided between the drive shaft of the operating member and the inner wall of a long hole formed in the swinging member so that the drive shaft can be placed in the long hole. The size of the clearance gradually increases when the operating member is repeatedly tilted. Therefore, in this structure, the operating member tends to generate noise, such as the rattling noise, in a vibrating environment if the apparatus is used for a long period of time.

SUMMARY OF THE INVENTION

In light of the above-described situation, the present invention provides a multi-directional input apparatus in which an operating member inserted through a long hole is prevented from serving as a noise source in a vibrating environment without increasing the cost.

According to an aspect of the present invention, a multi-directional input apparatus includes an operating member including a drive shaft; a base configured to support the operating member such that the operating member is tiltable in multiple directions; a long hole through which the drive shaft extends; and a swinging member supported on the base such that the swinging member is rotatable and such that an axial direction of the swinging member is substantially parallel to a longitudinal direction of the long hole. When the operating member is tilted in a direction crossing the axial direction of the swinging member, the swinging member is rotated by the drive shaft. At least one of the swinging member and the drive shaft is provided with an biasing unit configured to elastically bias the drive shaft against a side surface of an inner wall of the long hole.

In the multi-directional input apparatus having the above-described structure, the drive shaft of the operating member inserted through the long hole in the swinging member is pressed against the inner wall of the through hole by an elastic biasing force applied by the biasing unit. Therefore, rattling between the drive shaft and the inner wall of the long hole can be prevented. In addition, even when the tilting operation is repeated and the contact surfaces between the drive shaft of the operating member and the inner wall of the long hole are worn, rattling does not occur because the drive shaft is elastically biased by the biasing unit. Therefore, in the multi-directional input apparatus, the operating member does not serve as a source of noise, such as the rattling noise, in a vibrating environment. In addition, an inexpensive component, such as a spring member and an elastic piece, can be used as the biasing unit. Therefore, even though the biasing unit is additionally used, the cost can be prevented from being increased.

In the above-described structure, preferably, the biasing unit includes a spring member provided on one of the swinging member and the drive shaft. In such a case, the elastic biasing force can be applied to the drive shaft simply by adding a single inexpensive spring member. In this case, preferably, the spring member is a leaf spring provided on the swinging member, the leaf spring having a bent portion extending substantially parallel to the axial direction and being in elastic contact with the drive shaft. In such a case, when the operating member is tilted and the drive shaft slides along the bent portion, a portion of the drive shaft which is in contact with the bent portion changes in accordance with the inclination angle of the operating member. Therefore, even when the tilting operation is repeated, the portion of the drive shaft which is in contact with the leaf spring does not easily wear. As a result, detection errors caused by wear can be easily prevented. In addition, preferably, the leaf spring includes an attachment portion which is externally fitted to a frame portion of the swinging member, the frame portion surrounding the long hole, and a tongue piece which extends from the attachment portion and includes the bent portion at an end of the tongue piece. The attachment portion is provided with a hole for completely exposing the long hole. In this case, the leaf spring can be easily attached to the swinging member and the risk that the attachment portion of the leaf spring surrounding the long hole will interfere with the drive shaft can be eliminated.

DESCRIPTION OF THE PREFERRED EMBODIMENTS

Figure 1:
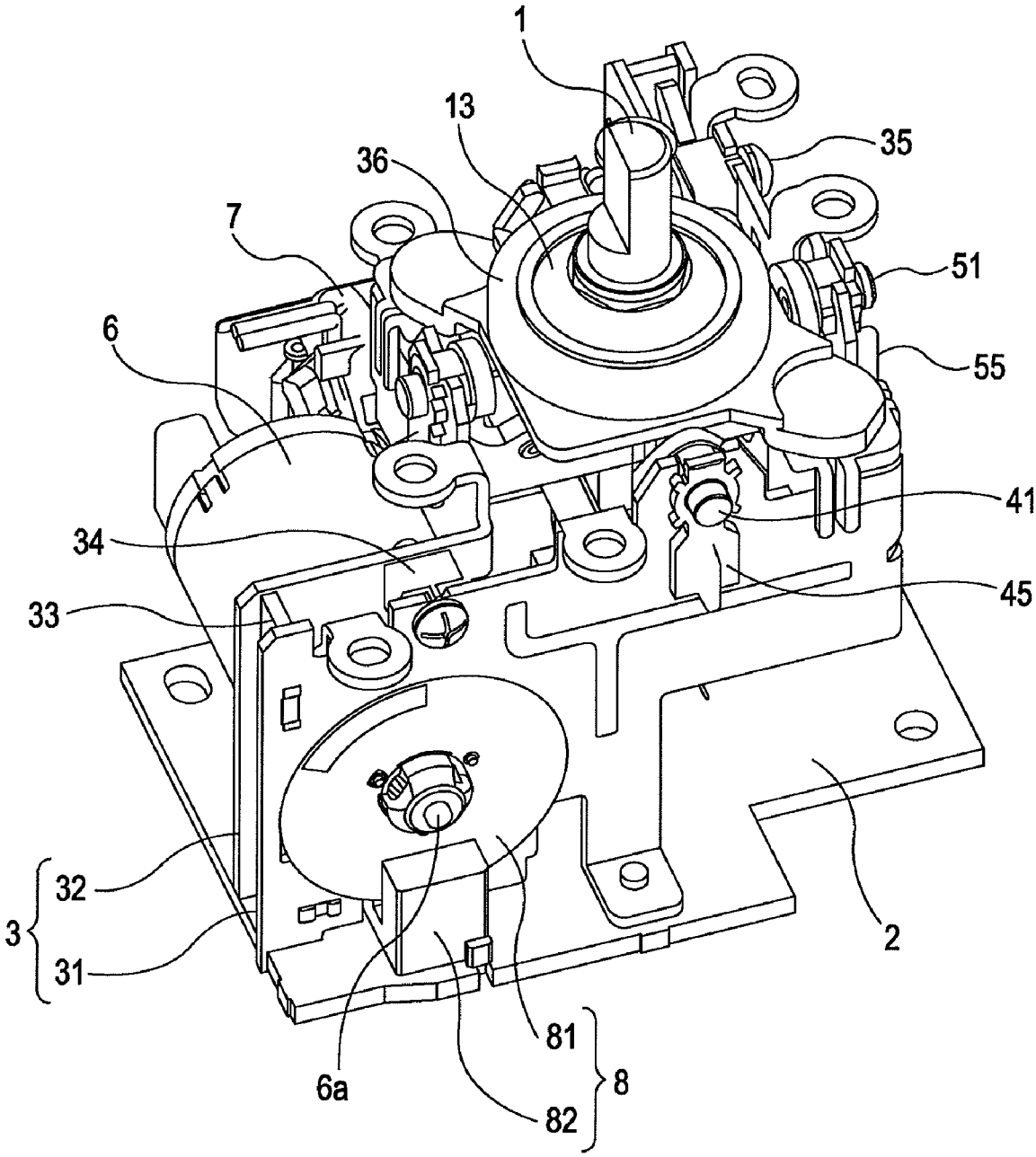
FIG. 1 is a perspective view of a multi-directional input apparatus according to an embodiment of the present invention.
Figure 2:
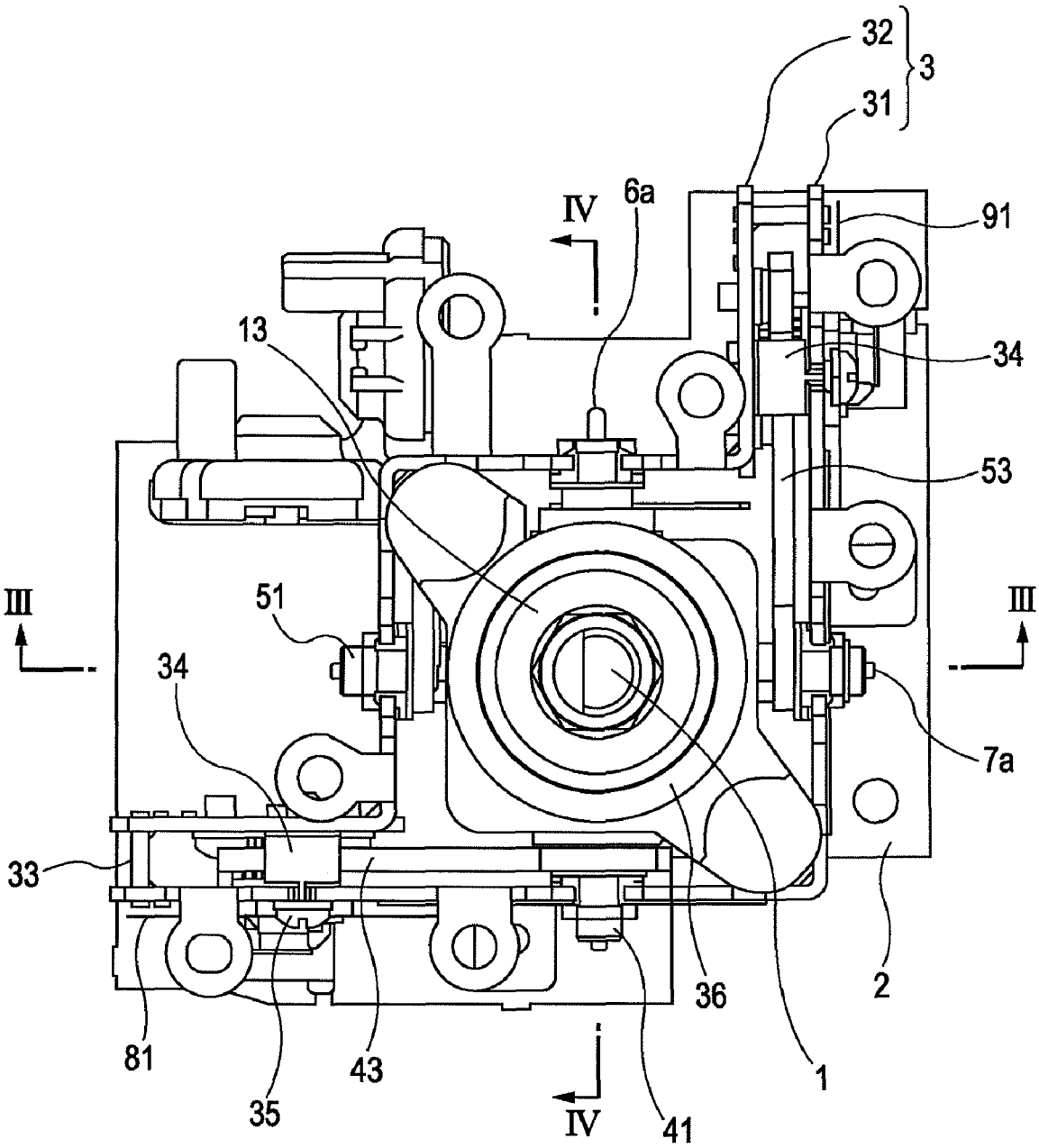
FIG. 2 is a plan view of the multi-directional input apparatus.
Figure 3:
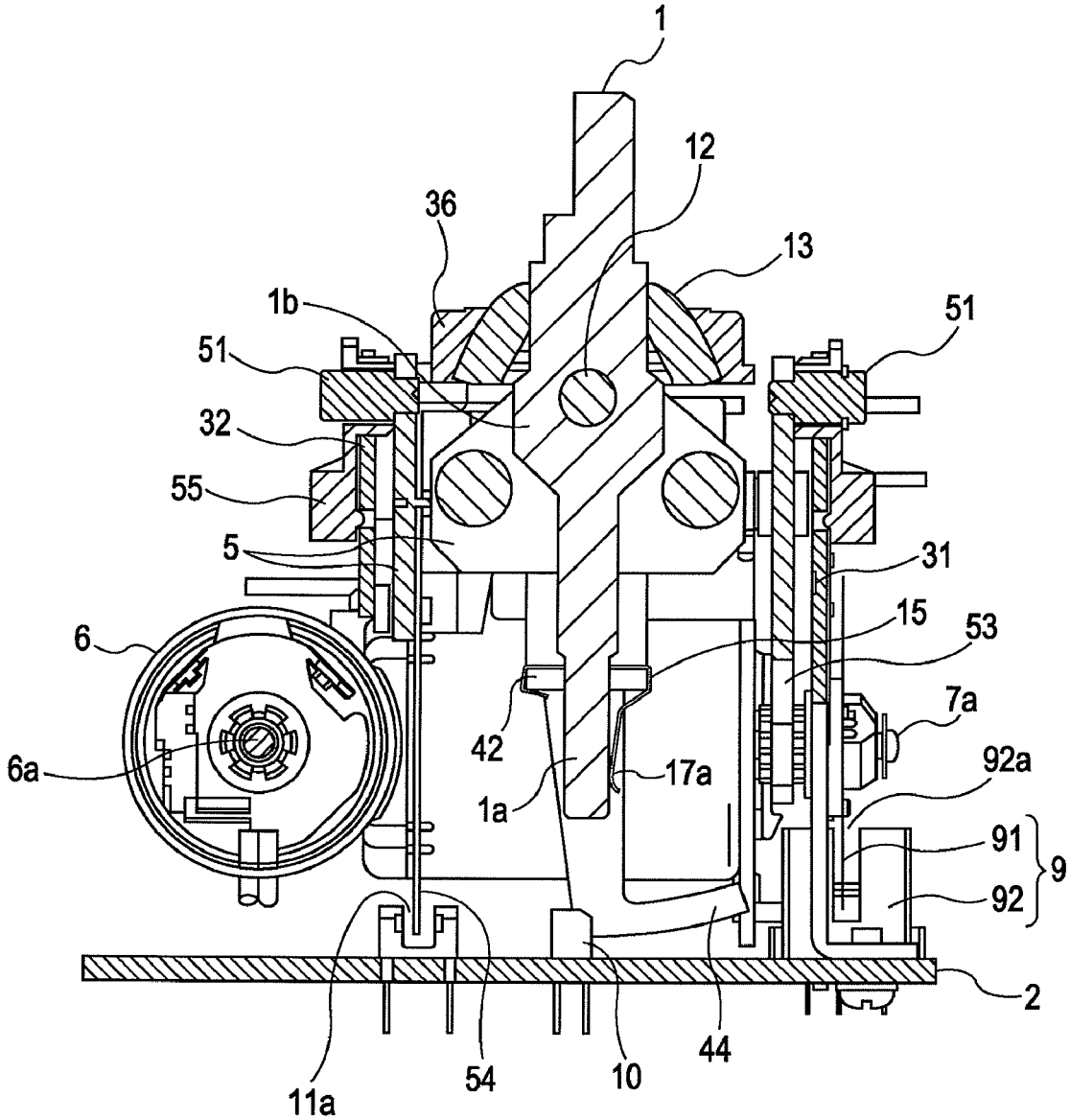
FIG. 3 is a sectional view of FIG. 2 taken along line III-III.
Figure 4:
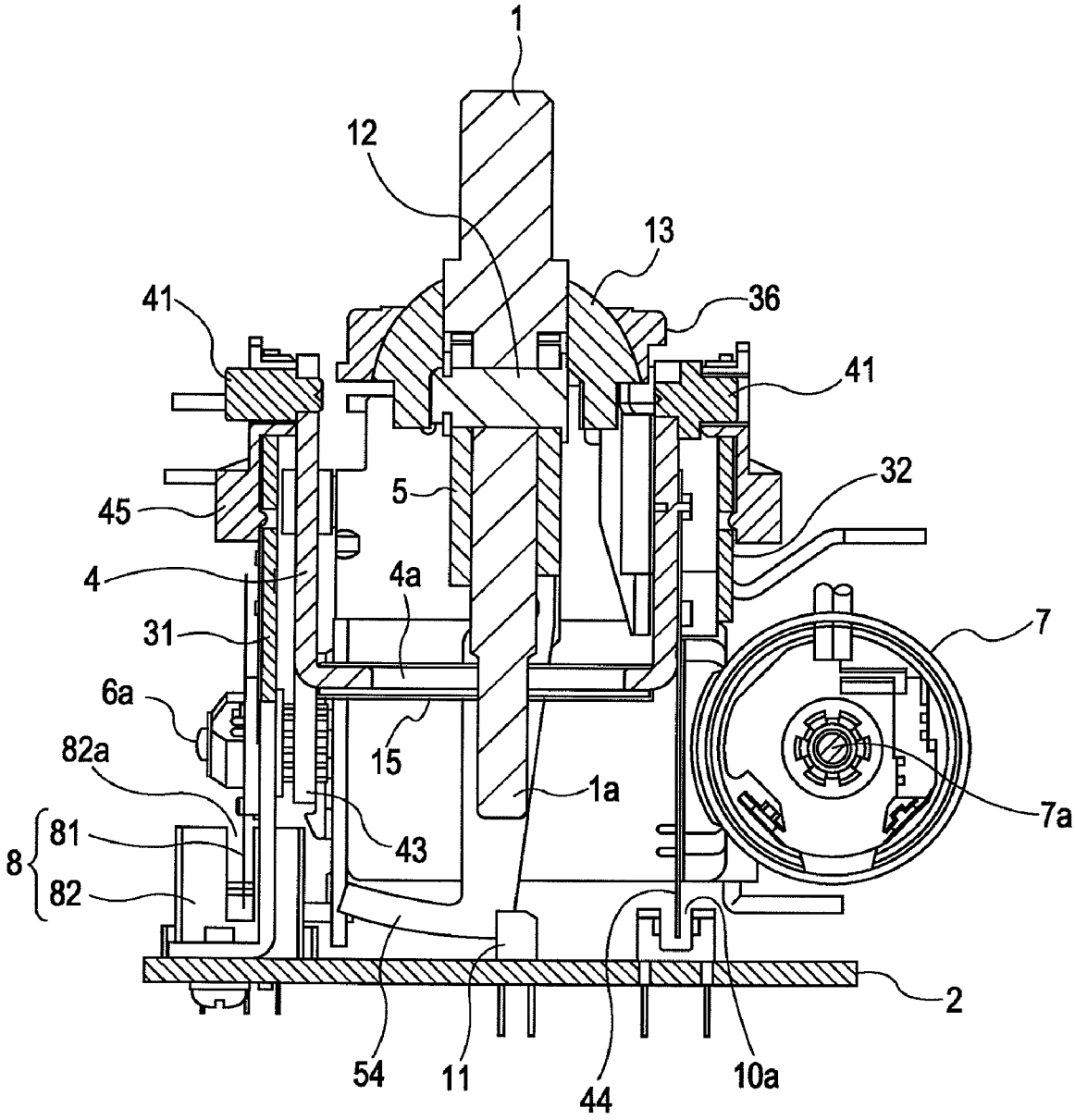
FIG. 4 is a sectional view of FIG. 2 taken along line IV-IV.
Figure 5:
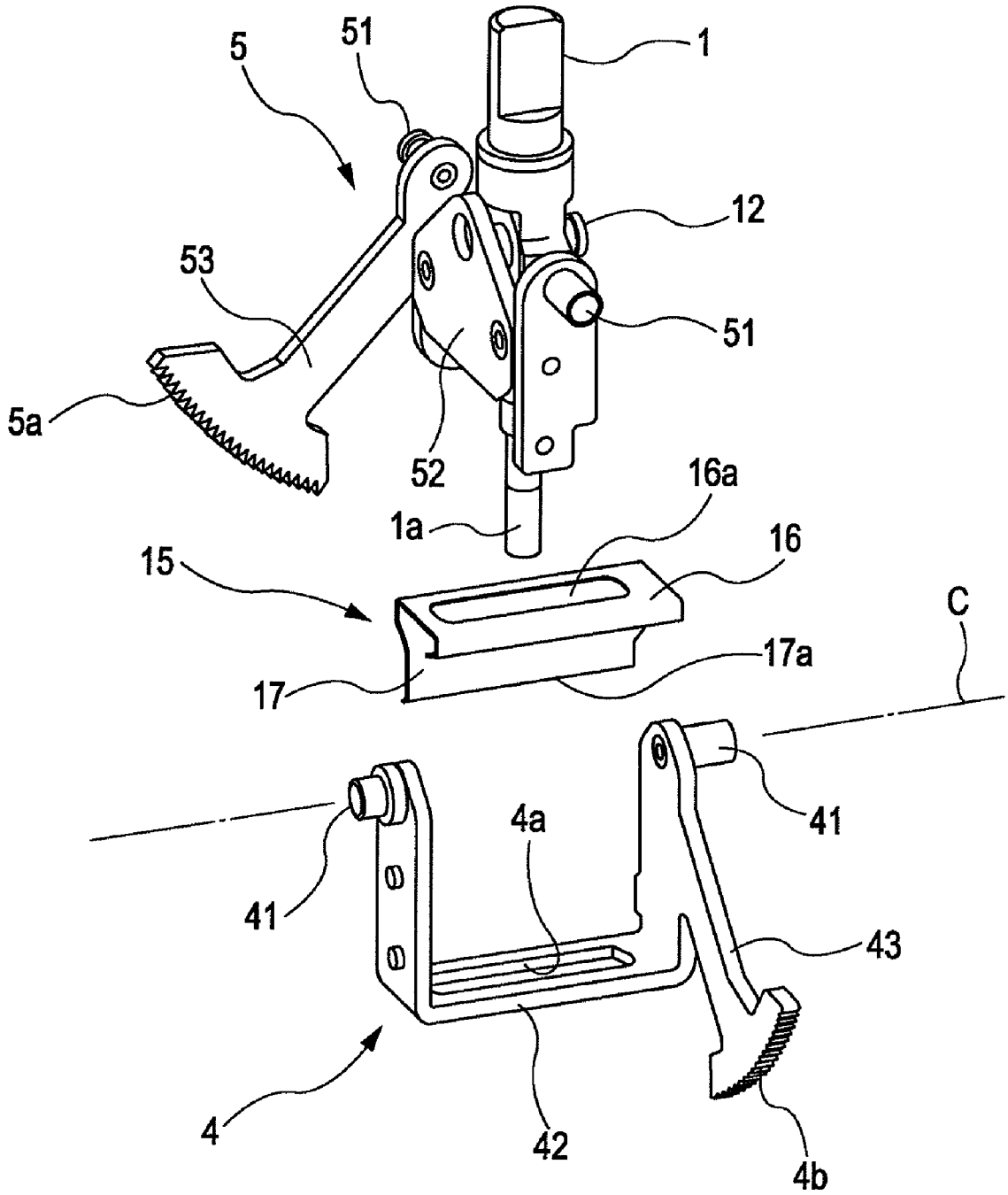
FIG. 5 is an exploded perspective view of an operating lever and a drive lever included in the multi-directional input apparatus.

An embodiment of the present invention will be described with reference to the accompanying drawings. FIG. 1 is a perspective view of a multi-directional input apparatus according to the embodiment of the present invention. FIG. 2 is a plan view of the multi-directional input apparatus. FIG. 3 is a sectional view of FIG. 2 taken along line III-III. FIG. 4 is a sectional view of FIG. 2 taken along line IV-IV. FIG. 5 is an exploded perspective view of an operating lever and a drive lever included in the multi-directional input apparatus. In FIG. 2, rotary motors are not shown.

The multi-directional input apparatus shown in the above-mentioned figures is a main section of a force-sense-imparting input apparatus which is mounted on a vehicle and in which an electrically controlled force sensation is applied to an operating lever (operating member). The force-sense-imparting input apparatus is an input apparatus having a force-feedback function in which functions of control devices, such as an air conditioner, an audio device, and a navigation device, that are mounted on the vehicle are adjusted using a single operating member. An operation of selecting a device or adjusting the functions of the device are performed by manually operating the operating lever. At this time, a resistive sensation or an external force, such as thrust, is applied in accordance with the amount by which the operating lever is operated and the direction in which the operating lever is operated. Thus, a good operational feel can be produced and a desired operation can be reliably performed.

The multi-directional input apparatus according to the present embodiment is accommodated in a housing (not shown) having a through hole in a top surface thereof and is installed in, for example, a center console of a vehicle. An input operation can be performed by tilting an operating lever 1 which projects upward through the through hole. The multi-directional input apparatus includes a base (frame) 3 which stands upright on a circuit board 2; first and second drive levers 4 and 5 which are rotatably supported on the base 3 such that axial directions of the first and second drive levers 4 and 5 extend perpendicular to each other; first and second rotary motors 6 and 7 mounted on the circuit board 2 such that rotating shafts 6*a* and 7*a* of the first and second rotary motors 6 and 7, respectively, extend perpendicular to each other; rotary encoders 8 and 9 and photo-interrupters 10 and 11 mounted on the circuit board 2; and a controller (not shown). The operating lever 1 can be tilted in an arbitrary direction, and the drive levers 4 and 5 can be rotated by an operational force applied by the operating lever 1.

The operating lever 1 includes a drive shaft 1*a* which extends downward, and the drive shaft 1*a* is inserted through a long hole 4*a* formed in the first drive lever 4. A lever shaft 12, which functions as a rotating shaft, extends through a central wide portion 1*b* (see FIG. 3) of the operating lever 1. The operating lever 1 is rotatably supported on the second drive lever 5 by the lever shaft 12. A sliding member 13 is fitted between the central wide portion 1*b* of the operating lever 1 and a restraining member 36. The sliding member 13 is in contact with a spherical inner wall surface (receiving surface) of the restraining member 36, which is formed integrally with the base 3. When the operating lever 1 is tilted, the sliding member 13 slides along the inner wall surface of the restraining member 36. An operating knob (not shown) is attached to the operating lever 1 at the top end thereof.

The base 3 includes two support plates 31 and 32 which are combined together with connecting plates 33 and spacers 34 provided therebetween. The support plate 31 is a metal plate having an L shape in a plan view, and the support plate 32 is a metal plate having a W shape in a plan view. The support plates 31 and 32 are disposed so as to face each other and are strongly fixed to each other by crimping such that the connecting plates 33 are provided between the support plates 31 and 32 at the ends thereof. The distance between the support plates 31 and 32 is accurately set by the spacers 34 fixed to the support plates 31 and 32 with screws 35.

The first drive lever 4 includes a pair of shafts 41 which face each other, a frame portion 42 having the long hole 4*a* formed therein, and a gear portion 43 (see FIG. 5). The gear portion 43 projects from a side wall which stands upright at an end of the frame portion 42 and includes a tooth section 4*b* at an end of the gear portion 43. An L-shaped detection plate 44 is fixed to a side wall which stands upright at the other end of the frame portion 42. The shafts 41 are rotatably attached to a top-end portion of the base 3 with bearings 45. A rotational centerline C (axial line of the first drive lever 4) which extends through the shafts 41 is parallel to the axial line of the lever shaft 12 and the longitudinal direction of the long hole 4*a*. When the first drive lever 4 is rotated, the detection plate 44 passes through a recess 10*a* in the photo-interrupter 10. The first drive lever 4 serves as a swinging member which rotates when the operating lever 1 is tilted.

In addition, the first drive lever 4 has a leaf spring 15 attached thereto (see FIGS. 3 and 5). The leaf spring 15 causes the drive shaft 1*a* of the operating lever 1 to be in elastic contact with the inner wall of the long hole 4*a*. The leaf spring 15 includes an attachment portion 16 and a tongue piece 17. The attachment portion 16 has a hole 16*a* and is externally attached to the frame portion 42. The tongue piece 17 extends from the attachment portion 16 and has a bent portion 17*a* at an end thereof. The hole 16*a* is a long hole that is slightly larger than the long hole 4*a*, and the long hole 4*a* is completely exposed at the hole 16*a* when the leaf spring 15 is attached to the frame portion 42. The bent portion 17*a* of the tongue piece 17 linearly extends in the axial direction (longitudinal direction of the long hole 4*a*) of the first drive lever 4, and is formed such that the bent portion 17*a* comes into elastic contact with a bottom end portion of the drive shaft 1*a*. Thus, the drive shaft 1*a* is elastically biased against a side surface of the inner wall of the long hole 4*a*.

The second drive lever 5 includes a pair of shafts 51 which face each other, a holder 52 on which the operating lever 1 is supported by the lever shaft 12, and a gear portion 53 (see FIG. 5). The gear portion 53 projects from the holder 52 at one side thereof and includes a tooth section 5*a* at the end of the gear portion 53. An L-shaped detection plate 54 is fixed to the holder 52 at the other side. The shafts 51 are rotatably attached to the top-end portion of the base 3 with bearings 55. A rotational centerline (axial line of the second drive lever 5) which extends through the shafts 51 is perpendicular to the axial line of the first drive lever 4 and the axial line of the lever shaft 12. Thus, the first and second drive levers 4 and 5 are supported on the base 3 such that the axial lines thereof extend perpendicular to each other, and the operating lever 1 extends through a section where the drive levers 4 and 5 intersect. Accordingly, the operating lever 1 is supported on the base 3 such that the operating lever 1 can be tilted in multiple directions. When the second drive lever 5 is rotated, the detection plate 54 passes through a recess 11*a* in the photo-interrupter 11. The second drive lever 5 supports the operating lever 1 and serves as a swinging holder which rotates when the operating lever 1 is tilted.

The rotary motors 6 and 7 are mounted on the circuit board 2 such that the rotating shafts 6*a* and 7*a* extend perpendicular to each other. The rotating shaft 6*a* of the first rotary motor 6 is connected to a central section of a code plate 81 included in the rotary encoder 8, and rotates together with the code plate 81. When an operating force for rotating the first drive lever 4 is applied, the rotating shaft 6*a* is rotated by the gear portion 43. Similarly, the rotating shaft 7*a* of the second rotary motor 7 is connected to a central section of a code plate 91 included in the rotary encoder 9, and rotates together with the code plate 91. When an operating force for rotating the second drive lever 5 is applied, the rotating shaft 7*a* is rotated by the gear portion 53.

The rotary encoder 8 includes the above-described code plate 81 and a photo-interrupter 82 which is mounted on the circuit board 2. A part of the code plate 81 is placed in a recess 82*a* in the photo-interrupter 82. The photo-interrupter 82 includes an LED (light emitting element) and a phototransistor (light receiving element) which face each other across the recess 82*a*, and information regarding the rotation of the code plate 81 can be obtained by the photo-interrupter 82. Similarly, the rotary encoder 9 includes the above-described code plate 91 and a photo-interrupter 92 which is mounted on the circuit board 2. A part of the code plate 91 is placed in a recess 92*a* in the photo-interrupter 92, and information regarding the rotation of the code plate 91 can be obtained by the photo-interrupter 92.

The photo-interrupter 10 includes an LED and a phototransistor (not shown) which face each other across the recess 10*a*. The photo-interrupter 10 outputs an ON signal when the detection plate 44 of the first drive lever 4 is not placed in the recess 10*a*. When the first drive lever 4 is rotated and the detection plate 44 enters the recess 10*a*, the light emitted from the LED is blocked and an OFF signal is output from the photo-interrupter 10. Similarly, the photo-interrupter 11 outputs an ON signal when the detection plate 54 of the second drive lever 5 is not placed in the recess 11*a*. When the detection plate 54 enters the recess 11*a*, an OFF signal is output from the photo-interrupter 11. The signals output from the photo-interrupters 10 and 11 are fed to the controller (not shown), and the controller calculates reference positions of the drive levers 4 and 5. The controller also receives signals obtained by the photo-interrupters 82 and 92 in the rotary encoders 8 and 9, respectively, and calculates the directions and amounts of rotation of the drive levers 4 and 5 with respect to the reference positions.

The above-described controller outputs control signals determined on the basis of data and programs stored in a memory to the rotary motors 6 and 7. The control signals correspond to an operational feel to be produced by the operating lever 1, and represents commands for, for example, generating vibrations or changing an operational force (resistive force or thrust). Circuit components of the controller are mounted on the bottom surface of the circuit board 2 or on another circuit board that is not shown in the figure.

The operation of the multi-directional input apparatus having the above structure will be now be described. When the system of the multi-directional input apparatus is activated (turned on), the controller reads the detection signals obtained by the photo-interrupters 10 and 11 and outputs the control signals to the rotary motors 6 and 7. Accordingly, the rotary motors 6 and 7 rotate the drive levers 4 and 5, respectively, so that the operating lever 1 returns to a neutral position. In this step, the rotary motors 6 and 7 rotate the drive levers 4 and 5 such that the outputs from the photo-interrupters 10 and 11 change from OFF to ON. The operating lever 1 reaches the neutral position when the outputs from the photo-interrupters 10 and 11 are both changed from OFF to ON.

Thus, the operating lever 1 is automatically returned to the neutral position. In this state, when an operator tilts the operating lever 1 in a certain direction, the first drive lever 4 and the second drive lever 5 are rotated by the drive shaft 1*a* of the operating lever 1 in accordance with the direction in which the operating lever 1 is tilted. The code plate 81 is rotated when the first drive lever 4 rotates around the center of the shafts 41, and the code plate 91 is rotated when the second drive lever 5 rotates around the center of the shafts 51. Accordingly, the information regarding the rotations of the code plates 81 and 91 is detected by the photo-interrupters 82 and 92 of the rotary encoders 8 and 9, respectively, and signals representing the information regarding the rotations are fed to the controller.

The controller calculates the directions and amounts of rotations of the drive levers 4 and 5 on the basis of the detection signals from the photo-interrupters 10 and 11 and the detection signals from the photo-interrupters 82 and 92, and outputs predetermined control signals to the rotary motors 6 and 7. For example, when the operating lever 1 is tilted in a certain direction by a certain amount, rotating forces based on the above-described control signals are transmitted from the rotary motors 6 and 7 to the drive levers 4 and 5, respectively. Accordingly, a resistive force is applied to the operating lever 1 through the drive levers 4 and 5 against the force applied to tilt the operating lever 1. As a result, the operator who manually operates the operating lever 1 recognizes the force applied to the operating lever 1 as a click feel.

Thus, in the multi-directional input apparatus according to the present embodiment, the first drive lever 4 has the long hole 4*a* through which the drive shaft 1*a* of the operating lever 1 is inserted, and the first drive lever 4 is rotated by the drive shaft 1*a* when the operating lever 1 is tilted in a direction which crosses the axial direction of the first drive lever 4. Since the leaf spring 15 is attached to the first drive lever 4, the drive shaft 1*a* is prevented from rattling in the long hole 4*a*. More specifically, in the multi-directional input apparatus, the tongue piece 17 (bent portion 17*a*) of the leaf spring 15 is in elastic contact with the bottom end portion of the drive shaft 1*a*, as shown in FIG. 3, so that the drive shaft 1*a* is softly pressed against a side surface of the inner wall of the long hole 4*a*. Therefore, rattling between the drive shaft 1*a* and the inner wall of the long hole 4*a* can be prevented. Even if the tilting operation is repeated and the contact surfaces between the drive shaft 1*a* and the inner wall of the long hole 4*a* are worn, the drive shaft 1*a* is prevented from rattling since the drive shaft 1*a* is elastically biased by the tongue piece 17 of the leaf spring 15. Therefore, in the multi-directional input apparatus, the operating lever 1 does not serve as a source of noise, such as the rattling noise, in a vibrating environment. In addition, the noise can be prevented simply by adding a single leaf spring 15, which is inexpensive, and the leaf spring 15 can be easily attached to the first drive lever 4 simply by externally fitting the attachment portion 16 to the frame portion 42 which surrounds the long hole 4*a*. Therefore, the cost of the apparatus can be prevented from being increased.

In addition, according to the present embodiment, the leaf spring 15 includes the bent portion 17*a* which extends substantially parallel to the axial direction of the first drive lever 4, and the bent portion 17*a* is in elastic contact with the drive shaft 1*a*. Therefore, when the operating lever 1 is tilted and the drive shaft 1*a* slides along the bent portion 17*a*, a portion of the drive shaft 1*a* which is in contact with the bent portion 17*a* changes in accordance with the inclination angle of the operating lever 1. Therefore, even when the tilting operation is repeated, the portion of the drive shaft 1*a* which is in contact with the leaf spring 15 does not easily wear. As a result, detection errors caused by wear can be easily prevented. In addition, the attachment portion 16 of the leaf spring 15 has the hole 16*a* at which the long hole 4*a* is completely exposed. Therefore, the attachment portion 16, which is disposed so as to surround the long hole 4*a*, is prevented from interfering with the drive shaft 1*a*.

According to the above-described embodiment, the leaf spring 15 which elastically biases the drive shaft 1*a* of the operating lever 1 is attached to the first drive lever 4 which has the long hole 4*a*. However, a spring member or an elastic piece other than the leaf spring may also be attached to the first drive lever 4. In addition, an biasing unit including a spring member or an elastic piece may also be provided on the drive shaft 1*a* such that the biasing unit is in elastic contact with a suitable portion (for example, the frame portion 42) of the first drive lever 4. Also in this case, effects similar to the above-described effects can be obtained. The present invention may also be applied to reduce noise in multi-directional input apparatuses other than the force-sense-imparting input apparatus.

What is claimed is:

1. A multi-directional input apparatus comprising:

an operating member including a drive shaft;

a base configured to support the operating member such that the operating member is tiltable in multiple directions;

a swinging member having a frame portion, the frame portion having a first elongated hole through which the drive shaft extends, the swinging member being supported on the base such that the swinging member is rotatable around a rotating axis perpendicular to a longitudinal axis of the drive shaft, and biasing means including a spring member which is a leaf spring provided on the swinging member, the leaf spring having an attachment portion partially surrounding the frame portion of the swinging member and a bent portion extending from the attachment portion and extending substantially along a longitudinal direction of the drive shaft and being in elastic contact with the drive shaft, the attachment portion having a second elongated hole through which the drive shaft extends, the second elongated hole being larger than the first elongated hole, the first and second elongated holes each having a longitudinal direction parallel to the rotating axis of the swinging member, wherein the swinging member is tilted in cooperation with operation of the operating member and when the operating member is tilted in a direction crossing the rotating axis of the swinging member, the swinging member is rotated by the drive shaft, wherein the biasing means is configured to elastically bias the drive shaft against a side surface of an inner wall of the first elongated hole.

2. The multi-directional input apparatus according to claim 1, wherein a tongue piece of the leaf spring is disposed between the attachment portion and an end of the driving shaft and elastically supports the driving shaft at a position closer to the end of the driving shaft than the attachment portion.

3. The multi-directional input apparatus according to claim 1, wherein the frame portion of the swinging member is disposed between the attachment portion of the leaf spring and a contact area of the bent portion where the bent portion is in elastic contact with the drive shaft.

4. The multi-directional input apparatus according to claim 1, wherein the attachment portion of the leaf spring and the frame portion of the swinging member each define an elongated shape having a longitudinal axis parallel to the rotating axis of the swinging member.

* * * * *

UNITED STATES PATENT AND TRADEMARK OFFICE

CERTIFICATE OF CORRECTION

PATENT NO. : 8,230,755 B2
APPLICATION NO. : 12/424256
DATED : July 31, 2012
INVENTOR(S) : Shinji Ishikawa et al.

It is certified that error appears in the above-identified patent and that said Letters Patent is hereby corrected as shown below:

On the Title Page

Item (73), after "Tokyo (JP)", insert --; Denso Corporation, Aichi-ken (JP)--.

Signed and Sealed this
Twenty-ninth Day of January, 2013

David J. Kappos

David J. Kappos
*Director of the United States Patent and Trademark Office*